US005295599A

United States Patent [19]

Smith

[11] Patent Number: 5,295,599

[45] Date of Patent: Mar. 22, 1994

[54] MULTIPLE CAP SEAL FOR CONTAINERS

[75] Inventor: James C. Smith, Hayward, Calif.

[73] Assignee: Innervision, Inc., Hayward, Calif.

[21] Appl. No.: 918,527

[22] Filed: Jul. 20, 1992

[51] Int. Cl.[5] ..... A61J 1/00; B65D 55/16

[52] U.S. Cl. ..... 215/204; 215/306; 215/278; 220/375; 220/339

[58] Field of Search ..... 215/204, 306, 273, 277, 215/278, 279; 220/259, 375, 339

[56] References Cited

U.S. PATENT DOCUMENTS

| | | | |
|---|---|---|---|
| 632,575 | 9/1899 | Kilbourn . | |
| 2,186,908 | 1/1940 | Page et al. . | |
| 2,705,573 | 4/1955 | Zepelovitch . | |
| 2,753,051 | 7/1956 | Tupper | 220/259 X |
| 2,935,219 | 5/1960 | Smith . | |
| 3,028,985 | 4/1962 | Pope . | |
| 3,430,777 | 3/1969 | Esposito . | |
| 3,567,013 | 12/1967 | Lannenbaum . | |
| 3,580,650 | 5/1971 | Morris . | |
| 4,152,269 | 5/1979 | Babson . | |
| 4,344,545 | 8/1982 | Aschberger et al. . | |
| 4,390,111 | 6/1983 | Robbins et al. | 220/259 |
| 4,397,400 | 8/1983 | Walter | 220/259 |
| 4,674,640 | 6/1987 | Asa et al. | 215/306 X |
| 4,718,567 | 1/1987 | La Vange | 215/237 X |
| 4,735,358 | 6/1988 | Virca . | |
| 4,896,780 | 1/1990 | Jessop et al. . | |
| 4,956,103 | 9/1990 | Jessop et al. | 215/306 X |
| 5,000,236 | 3/1991 | Jennison . | |

*Primary Examiner*—Allan N. Shoap
*Assistant Examiner*—Paul A. Schwarz
*Attorney, Agent, or Firm*—Townsend and Townsend Khourie and Crew

[57] ABSTRACT

A multiple cap arrangement is provided to seal the open end of a container. The multiple cap seal includes a sealing cap and locking cap which are hingedly coupled to the open end of a container such as a disposable centrifuge container. The sealing cap is lodged in the open end of the container and the locking cap coupled to the sealing cap by a mechanism that retains the caps essentially fixed relative to one another. With the caps coupled in this way, stress, resulting from pressure in the container, is transferred through the caps to the hinges. The hinges are sized to prevent axial movement of the interlocked sealing and locking cap structure away from the container. Since the hinges resist stretching even under substantial tension, the container remains reliably sealed even when the pressures in the container are very high.

15 Claims, 5 Drawing Sheets

MULTIPLE CAP SEAL FOR CONTAINERS

BACKGROUND OF THE INVENTION

1. Field of the Invention

The invention relates generally to a sealing device or closure for a container, and more particularly, to a sealing device having a releasable lock.

2. Background

Containers such as test tubes have been used for many years to store sample materials such as liquids. There is often a need to seal the open end of a test tube with a removable cap to prevent contamination or loss of the sample while allowing for subsequent re-access to the sample. Also, when material has been placed in test tubes, it is sometimes necessary to remove from or add to the material without removing the cap. This can be done by using a syringe to puncture the cap. However, some caps are difficult to puncture because of their wall thickness. After a typical container cap is punctured with a syringe, the punctured cap cannot reseal the container.

A typical removable cap relies on a frictional fit between the cap and the inside surface of the test tube to seal the test tube and to retain the cap. Sometimes the cap and test tube are molded together from a plastic material, with the cap attached to the test tube by a hinge. There are disadvantages to frictional cap seals. If the test tube is dropped, the cap has a tendency to pop off, thus spilling or contaminating the sample. Heating and cooling cycles can loosen the cap, allowing it to come off the test tube. Evaporation of a sample will often occur unless the cap makes a hermetic seal with the test tube. The seal and the retention of a friction fit cap can be heightened by increasing the friction fit between the cap and test tube. However, increasing the friction between cap and container makes installation and removal of a cap much more difficult. Such difficulty can cause user fatigue when the user must cap or uncap many test tubes. Furthermore, it may be costly to achieve a precise friction fit due to tight dimensional constraints required for the inside surface of the tube and the outside surface of the cap.

SUMMARY OF THE INVENTION

The present invention is directed to a seal for a container, such as a disposable centrifuge container, that avoids the problems and disadvantages of the prior art. The invention accomplishes this goal by providing a multiple cap seal having a sealing cap and a locking cap that are hinged to a container having an open end. The sealing cap is pivoted about it's hinge and a portion thereof is positioned in the open end of the container to form a seal therewith. The locking cap is then pivoted about it's hinge and positioned over the sealing cap. The multiple cap seal further includes a locking mechanism that releasably locks the sealing and locking caps together and prevents relative movement therebetween when the sealing cap is positioned in the opening of the container. The hinges are dimensioned such that the combined locked sealing and locking cap structure is precluded from axially moving away from the open end of the container without consequent hinge deformation or failure. In this way, the sealing cap is reliably retained in its sealing position and closure integrity against specimen loss is ensured when relatively high pressures develop in the container, such as when the container is heated or dropped. Additionally, the sealing caps can readily be removed once the locking mechanism is unlocked.

According to another aspect of the invention the sealing cap can include a cup-shaped member that is easily inserted into the open end of the container to seal the container. Preferably, the cup-shaped member is expandable to enhance the seal between the cup-shaped member and the inner wall(s) of the container. To this end, the cup-shaped member is provided with a concave bottom wall and the locking cap is provided with a projection. When the locking cap is pivoted over the sealing cap, the projection enters the cup-shaped member and displaces the concave bottom wall such that the cup-shaped member expands radially outward to firmly engage the inner wall(s) of the container.

According to another aspect of the invention the locking cap is provided with a cylindrical member that closely fits into the cup-shaped member. This arrangement prevents significant lateral movement between the caps and can be constructed to provide a frictional fit sufficient to lock the caps together. Alternatively, the locking mechanism can comprise a detent arrangement and the cooperating elements provided on the cylindrical and cup-shaped members such that the sealing and locking caps are automatically locked together when the cylindrical member is seated in the cup-shaped member. In a further embodiment the locking mechanism comprises a latch arrangement having in a latch arm provided on the locking cap and the latch lip provided on the container. In this case, as the cylindrical member is introduced into the cup-shaped member, these members cooperate and guide the locking cap to align the latch mechanisms into engagement.

Another feature of the present invention is a syringe access provided in the first cap. The container can be accessed by removing the locking cap and penetrating the syringe access with the syringe. The container then can be hermetically resealed by merely re-engaging the locking cap with the sealing cap when the caps are constructed to provide a hermetic seal therebetween. Alternatively both the first and second caps can have syringe ports.

It should be understood that the language used in the specification has been chosen to aid in disclosure, and not to limit the inventive subject matter. For example, the term "tube" is used to designate the object to be sealed, but containers such as bottles or open-ended objects such as pipes can also be sealed with the present invention.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENTS

Figure 1:
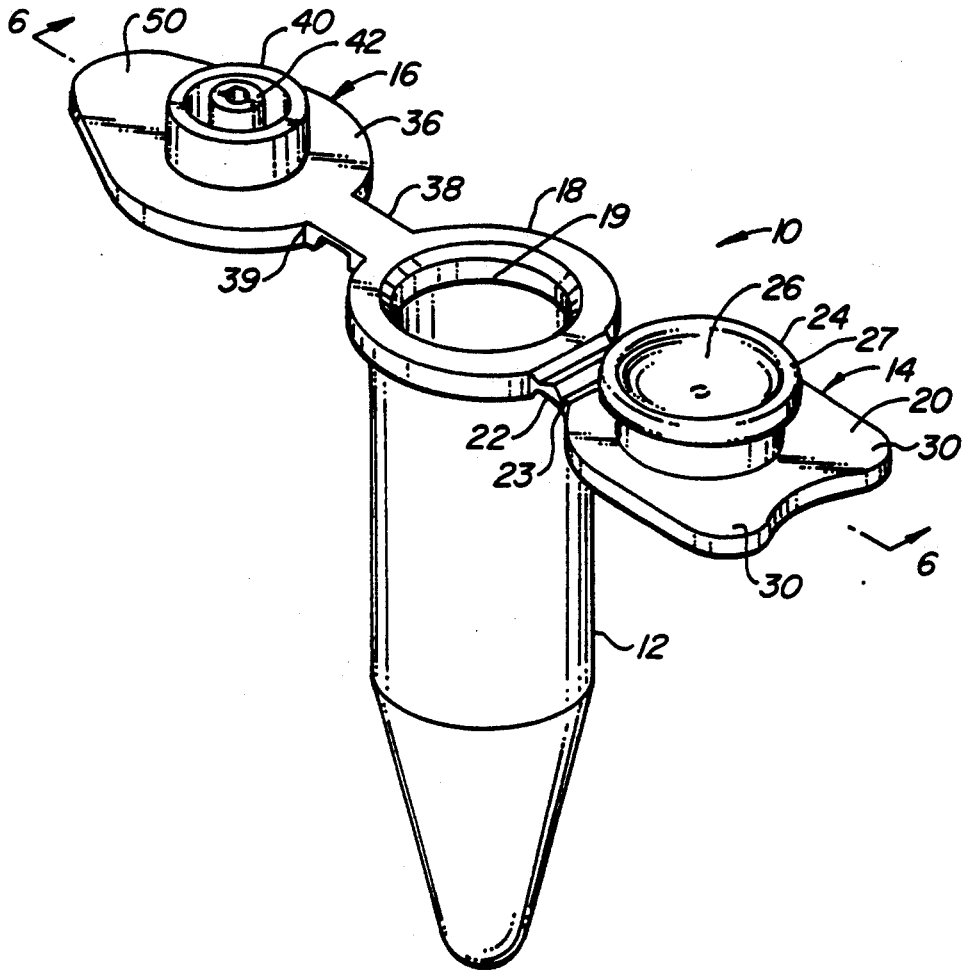
FIG. 1 is a perspective view of a multiple cap seal constructed according to a first embodiment of the present invention.
Figure 2:
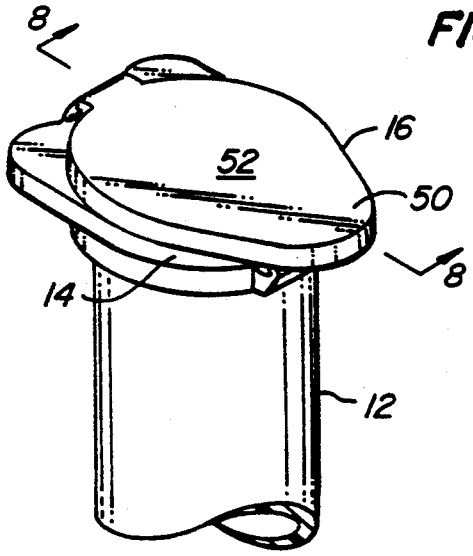
FIG. 2 is a perspective view of the multiple cap seal of FIG. 1 in a sealed or closed state.
Figure 3:
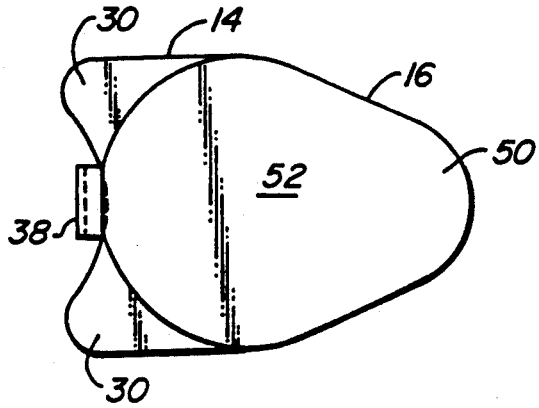
FIG. 3 is a top view of the multiple cap seal illustrated in FIG. 2.
Figure 4:
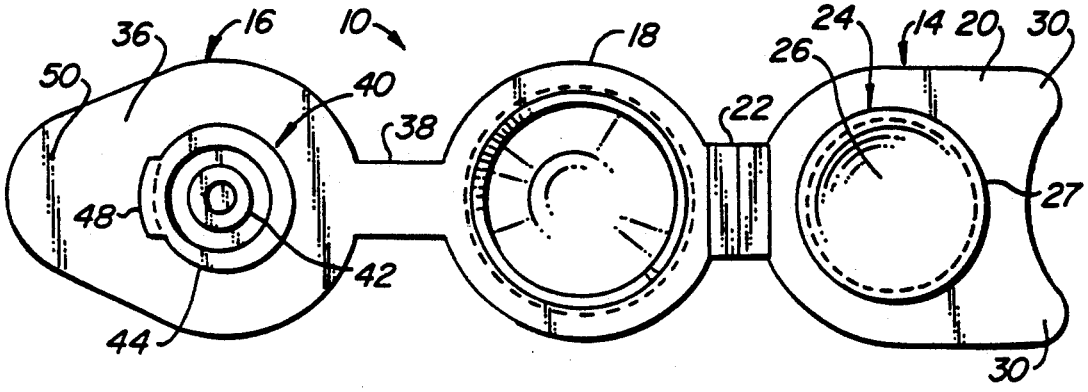
FIG. 4 is a top view of the multiple cap seal of FIG. 1.
Figure 5:
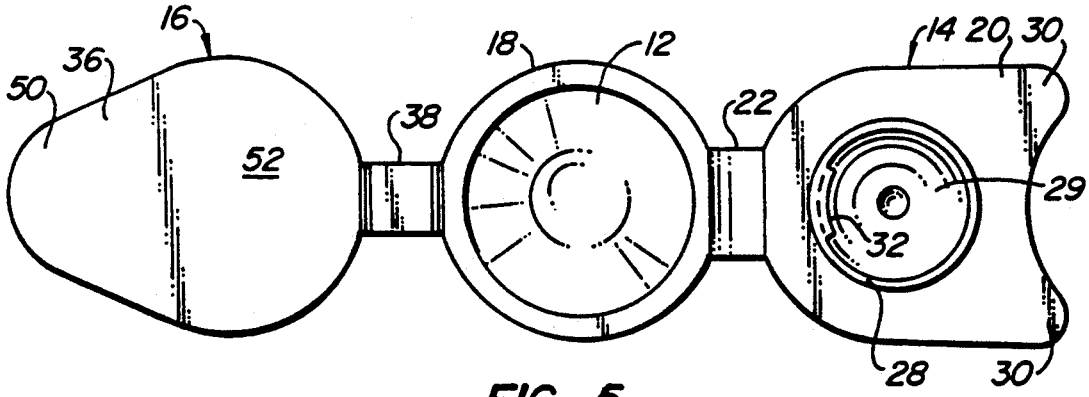
FIG. 5 is a bottom view of the multiple cap seal of FIG. 1.
Figure 6:
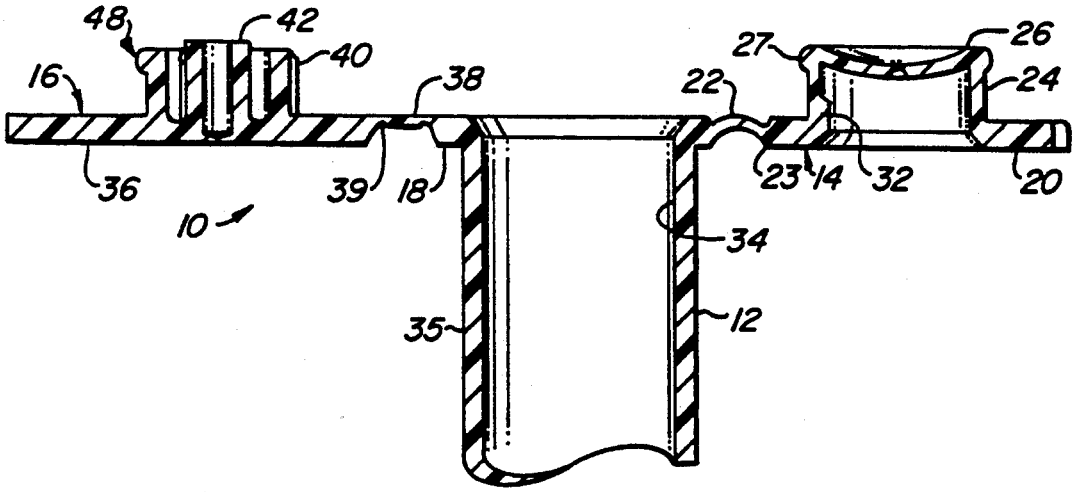
FIG. 6 is a side sectional view of the multiple cap seal of FIG. 1.

Referring to the drawings in detail, wherein like numerals indicate like elements, preferred embodiments of the multicap seal are illustrated in accordance with the principles of the present invention. Although the illustrated embodiments of the multiple cap seal are shown in conjunction with a centrifuge container or tube, it should be understood that they can be used with other containers such as bottles and the like.

Referring to FIGS. 1–8, multiple cap seal 10 includes a sealing cap 14, a locking cap 16, and a collar 18. Both caps 14 and 16 are hingedly attached to collar 18 that includes an aperture or opening 19 that forms the opening of an open-ended tube 12, which may be a disposable centrifuge container, for example. Preferably, the test tube and multiple cap seal are integrally formed as a one-piece structure by injection molding, for example. Accordingly, the test tube and multiple cap seal preferably comprise polypropylene or polyethylene.

Sealing cap 14 includes a generally flat member or flange 20, attached or coupled to collar 18 by hinge 22, and a cup-shaped member sized to fit through opening 19 and into test tube 12. Cup-shaped member 24 extends from flange 20 and includes circular bottom wall 26, annular rim 27, and an annular side wall 28 that form a cavity or recess 29 for receiving a portion of locking cap 16 as will be discussed in detail below. Bottom wall 26 is concave when in a relaxed state, as shown, for example, in FIGS. 6 and 7. As evident from the drawings, rim 27 extends radially outward from cup-shaped member 24 to form a peripheral lip on the region of bottom wall 26. The end of flange 20 opposite hinge 22 extends outwardly forming two tabs 30. Tabs 30 are pushed upwardly to facilitate the removal of sealing cap 14 from test tube 12.

Figure 7:
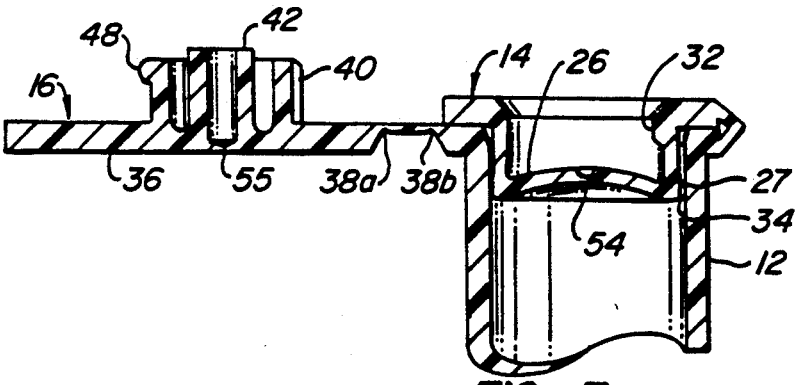
FIG. 7 is a side sectional view of the multiple cap seal of FIG. 1 in a partially sealed state.

Cup-shaped member 24 is configured to fit readily into opening 19 and, thus, the open end of the test tube 12. As best shown in FIG. 7, the diameter of rim 27 of cup 24, in the as-molded or relaxed state, is approximately equal to the inside diameter of the tube 12. However, cup-shaped member 24 can be sized to provide a slight frictional fit between rim 27 and the inner walls of tube 12. To this end, the outer diameter of ring 27 is sized to be about 0.001 to 0.005 inch greater than the inner diameter of tube 12. In any case, the fit should not be so tight that so as to unduly restrict relative movement between cup-shaped member 24 and tube 12 during insertion or removal of sealing cap 14.

As illustrated in FIGS. 1–8, locking cap 16 includes a generally flat member or flange 36, which is attached or coupled to collar 18 by hinge 38 and protrusions 40 and 42. One side of member 36 has a generally flat surface, whereas the opposite side of member 36 has protrusions 40 and 42 extending therefrom. Protrusions 40 and 42 have a generally cylindrical shape and are concentrically positioned relative to one another as can be seen, for example, in FIGS. 1 and 4. Inner cylindrical protrusion 42 displaces concave bottom 26 of cup-shaped member 24 when locking cap 16 is inserted into sealing cap 14 FIG. 8. When the end of inner cylindrical protrusion 42 is fully seated, concave bottom 26 is flattened and rim 27 expanded outwardly against inner wall surface 34 of tube 12, thereby improving the seal between sealing cap 14 and tube 12. Projection 40 is sized such that when seated in cavity 29 lateral movement of locking cap 16 is substantially prevented. Although rim 27 is illustrated as being integrally formed with cup-shaped member 24, other constructions can be used without departing from the scope of the invention. For example, an annular groove can be formed in cylindrical side wall 28 and an O-ring comprising natural rubber or an elastomeric material seated therein to form the annular lip or rim 27. This construction would be especially advantageous in applications where a virtually fail-safe hermetic seal is required.

Figure 8:
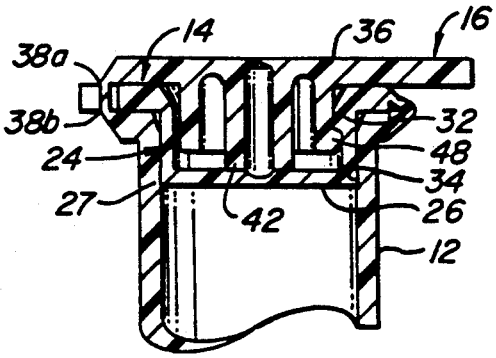
FIG. 8 is a side sectional view of the multiple cap seal of FIG. 1 in a sealed state.

Outer protrusion 40 includes a tab 48 that protrudes radially outward for engaging a ridge 32 that protrudes from the inner surface of cup-shaped member wall 28 toward the center of cavity 29. Tab 48 and ridge 32 are configured to form a detent mechanism such that tab 48 slides over and snaps into place under ridge 32 to facilitate retention of the sealing and locking caps in their closed position (FIG. 8). In this way, the locking cap and sealing cap are releasably locked together and relative movement therebetween prevented (e.g., the sealing and locking caps 14, 16 are prevented from pivoting about hinges 22, 38). The height of the inner cylindrical protrusion 42 is selected so that the concave bottom is substantially flattened when the locking cap 16 is locked in place by tab 48 and ridge 32. The end of flange 36 opposite hinge 38 extends outwardly forming a tab 50, which, when pushed upwardly, facilitates removal of locking cap 16 from sealing cap 14. Although a detent mechanism has been described to secure or lock the locking cap to the sealing cap, other mechanisms can be used. For example, projection 40 can include a plurality of ribs circumferentially spaced about its outer wall and sized to sufficiently frictionally engage the inner surface of wall 28 of the cup-shaped member. Alternatively, the outer diameter of protrusion 40 can be sized so that locking cap 16 frictionally engages the inner surface of wall 18 to the extent necessary to keep the caps secured to one another. A latch mechanism is a further alternative, and is described in detail below.

Figure 9:
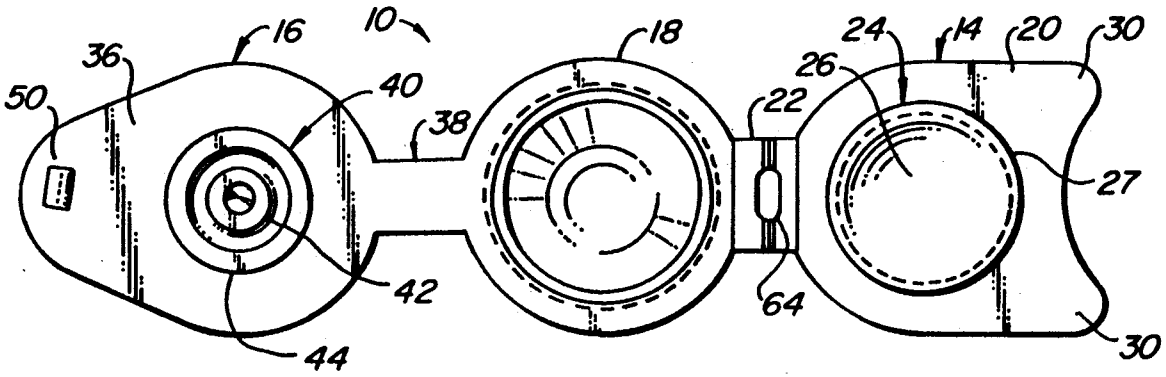
FIG. 9 is a top view of a multiple cap seal constructed according to another embodiment of the present invention.
Figure 10:
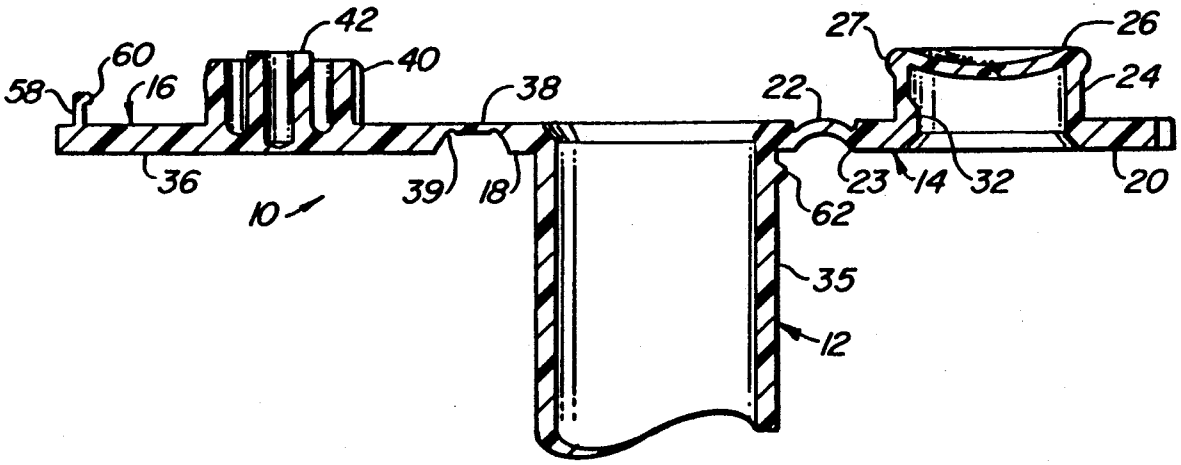
FIG. 10 is a side sectional view of the multiple cap seal of FIG. 9.

Referring to FIGS. 9 and 10, the aforementioned latch-type retaining mechanism is shown. This mechanism also facilitates securing sealing and locking caps 14,16 together to prevent relative movement therebetween when the caps are in the closed position. This retaining mechanism comprises an elongated member or latch arm 58, including ridge 60, and lip 62. Latch arm 58 extends from the underside of flange 36 of locking cap 16, while lip 62 is formed on the outer surface 35 of tube 12. When the sealing and locking caps are placed in their closed positions (in the opening of tube 12), latch arm 58 extends past or through opening 64 in hinge 22 where ridge 60 slides over and snaps into place under lip 62 such that locking cap 16 is releasably locked to tube 12. Projection 40 and cavity 29 are positioned and configured such that the latch arm is guided into engagement with lip 62 as projection 40 slides into cavity 29, as evident from the drawings. When latch arm 58 is coupled to lip 62, flange 36 of locking cap 16 abuts flange 20 of sealing cap 14, Thus, sealing cap 14 is prevented from moving away from tube 12. Additionally, since sections of flange 20 of sealing cap 14 abut collar 18 (FIGS. 7 and 8), further movement by sealing cap 14 toward tube 12 is prevented. Accordingly, the sealing and locking caps are locked together such that relative movement therebetween is prevented.

Once the locking cap has been secured to the sealing cap with any of the retaining mechanisms described above, hinges 22 and 38 work in conjunction with the retaining mechanism to prevent the interlocked cap structure from being displaced axially away from the tube. Hinge 22 interconnects sealing cap 14 and container 12 at region 23, while hinge 38 interconnects container 12 and locking cap 16 at region 39 (See e.g., FIGS. 6 and 10). The length of hinge 22 is selected such that when cap 14 has been placed in its closed position, axial movement of region 23 of sealing cap 14 away from the open end of container 12 is prevented due to the hinge's resistance to stretch. As illustrated in FIG. 7, when cap 14 is placed in its closed position it extends from the open end of the container a distance equal to the thickness of flange 20. Accordingly, hinge 22 is constructed to have a length substantially equal to the thickness of flange 20 to prevent region 23 from moving away from collar 18. The length of hinge 38 is such that it similarly precludes any significant movement of region 39 of locking cap 16 away from the open end of the container, when the second cap has been placed in its closed position. As illustrated in the drawings, hinges 22 and 38 are circumferentially spaced about 180° from one another. When hinges 22 and 38 are spaced as such, the combined locking and sealing cap combination is prevented from pivoting. Additionally, hinge 38 preferably is provided with two pivot points 38*a*, 33*b* (FIG. 7) that are spaced apart a distance essentially equal to the thickness of sealing cap flange 20 so that the locking cap flange 36 can lay flat upon flange 20 as illustrated in FIG. 8. This enhances the distribution of forces between the flanges and transfer of stresses to hinges 22 and 38. Also, this construction permits uniform compression of sealing cap flange 20 by locking cap flange 16 to enhance the seal between flange 20 and collar 18.

It has been found that with the above hinge and cap interlock combination, forces within the container can dislodge the locking and sealing caps from their closed position only if hinge 22 or hinge 38 is broken. For example, cap 24 cannot be dislodged while hinge 22 is intact since cap 24 is held in place by locking cap 16 and hinge 38. The hinges are constructed such that substantial force is required to break a hinge. Thus, the combined effect of hinges 22 and 38, and either retainer (e.g., the above-described detent or latch mechanism) serves to securely retain the locking and sealing caps within the open end of a container.

Merely to exemplify a preferred makeup of components that have been found to produce the desired effects, the following example may be recited. It is understood that this example is given by way of illustration and is not intended to limit the scope of this invention. Hinge 22 has a length of about 0.134 inch, while hinge 38 has a length of about 0.130 inch. The wall thickness of each flange 20, 36 is about 0.050 inch, while the wall thickness of tube 12 is about 0.035 inch. The outer diameter of tube 12 in the region adjacent the open end is about 0.375 inch and outer diameter of rim 27 is about 0.302 inch in the relaxed state. Although other materials may be used, the cap and tube assembly is preferably polypropylene.

A syringe access mechanism can be provided in any of the embodiments described above. Referring to FIG. 7, for example, a syringe port or access mechanism 54 is shown in the bottom wall 26 of the sealing cap 14. As is evident from the drawings, syringe port 54 is in the form of a recess in the wall. The recess forms a reduced wall thickness section that facilitates syringe penetration through the bottom wall 26 of sealing cap 14 such that the syringe can be readily inserted into the tube without removing sealing cap 14. A similar syringe port 55 also is provided in locking cap 16. If only syringe port 54 is used, and syringe port 55 remains unused and, thus, sealed, locking cap 16 can then be reinserted into cup-shaped member 24 to once again hermetically seal the tube provided an appropriate seal is formed between the sealing cap and locking cap. Such a seal can be accomplished by providing a continuous frictional fit between protrusion 40 and the inner surface of cup-shaped member wall 28.

Figure 11:
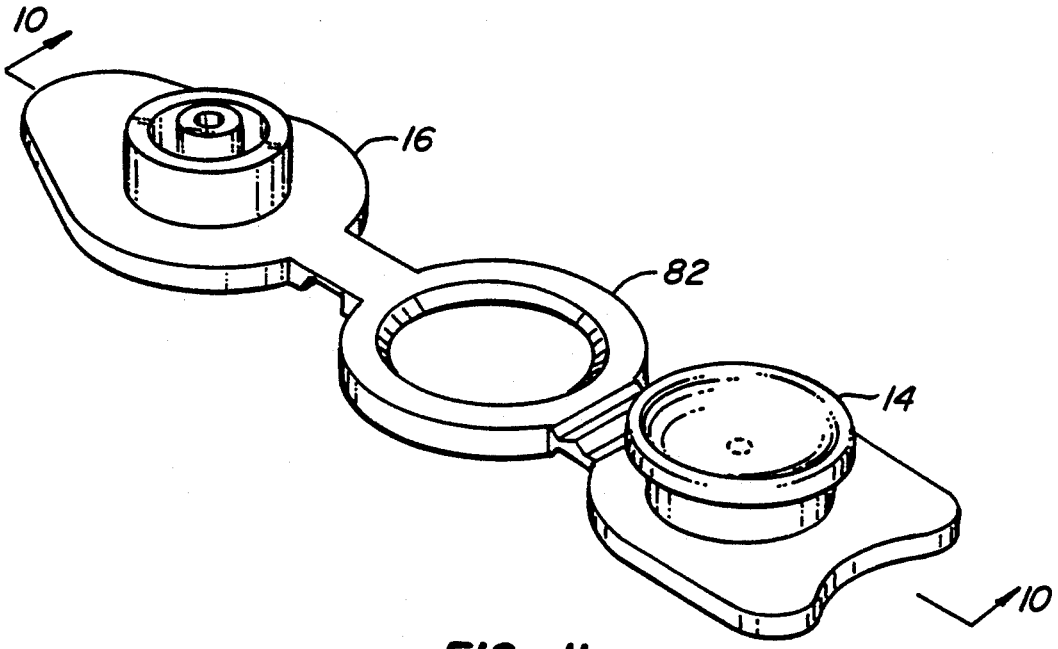
FIG. 11 is a perspective view of a multiple cap seal constructed according to a further embodiment of the present invention.
Figure 12:
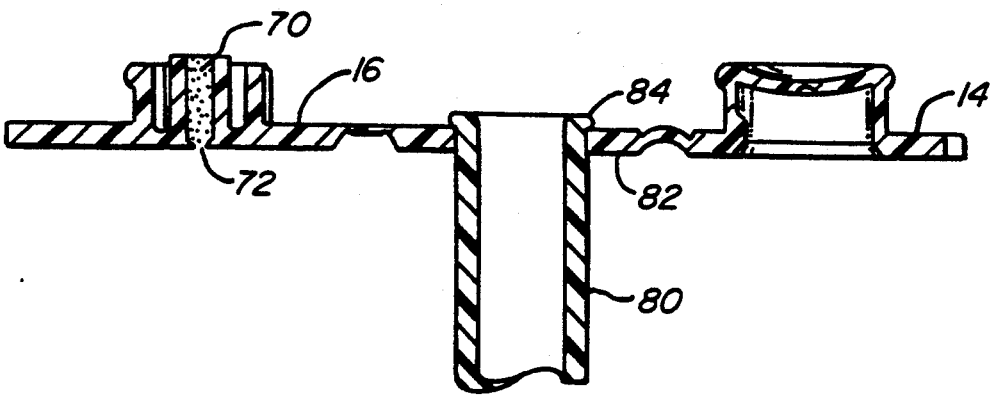
FIG. 12 is a side section view of the multiple cap seal of FIG. 11 coupled to a tube.

As noted above, the multiple cap seal need not be integrally-molded with a tube or container. Referring to FIGS. 11 and 12, the multicap seal is shown as a discrete element provided with a collar 82 having an opening sized to accommodate container 80. It is important, however, that the collar is sufficiently secured to container 80 such that the collar does not become separated from tube 80 when the hinges are under load. To this end, retaining lip 84 is provided to prevent collar 82 from unintentionally slipping off tube 80. The locking cap 16 and sealing cap 14 of this embodiment are configured as described above. Additionally, a filter 70 and opening 72 can be provided in the locking cap to allow the contents of the tube to be ventilated as illustrated in FIG. 12.

The above is a detailed description of particular embodiments of the invention. It is recognized that departures from the disclosed embodiments may be made within the scope of the invention and that obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. A sealing device comprising:

a first member having an opening;

a second member having a portion sized to fit in said opening and a section that engages said first member adjacent said opening when said portion is positioned in said opening;

a substantially imperforate third member having a portion that engages said second member when said second member portion is positioned in said opening and said third member is positioned on said second member;

a first flexible hinge integrally formed as a single one-piece element and having a first end attached to said first member and a second end attached to said second member, said hinge having a length such that said section of said second member is prevented from vertically separating from said first member when said second member portion is positioned in said opening; and a second flexible hinge integrally formed as a single one-piece element and having a first end attached to said first member and a second end attached to said third member, said second hinge having a length such that a section of said third member portion is prevented from vertically separating from said second member when said second member portion is positioned in said opening and said third member is positioned on said second member.

2. The sealing device of claim 1 including means for retaining said second and third members together.

3. The sealing device of claim 2 wherein said retaining means is formed on said first and third members.

4. A sealable container comprising:

a tubular member having an open end;

a sealing cap including a portion configured to occlude the open end of said tubular member when said sealing cap is positioned over said open end, said sealing cap portion including a cup-shaped member formed with a depression that is sized to fit through the open end of said tubular member;

a locking cap having a portion comprising a protrusion shaped to fit into said depression;

means for releasably locking said sealing and locking caps together with said protrusion secured within said depression when said caps are positioned over said open end; and means for preventing said caps from significantly moving in a direction away from the open end of said tubular member when said caps are positioned over said open end and locked together, said preventing means comprising first and second hinges, each having an end extending from said tubular member and being coupled to one of said sealing and locking caps.

5. The container of claim 4 wherein said tubular member includes a generally cylindrical inner wall, said cup-shaped member includes a concave bottom wall having a generally circular rim, and said locking cap includes means for displacing said concave bottom wall such that said rim is expanded radially outward and toward said inner wall when said cup-shaped member is positioned in the open end of said tubular member.

6. The container of claim 4 wherein said releasable locking means comprises a detent mechanism including a pair of cooperating members, one of said members being formed on said sealing cap and the other of said members being formed on said locking cap.

7. The container of claim 4 wherein said releasable locking means comprises a latch mechanism including a latch arm and a lip configured to cooperatively engage one another, said latch arm extending from said locking cap and said lip extending from said tubular member.

8. The container of claim 7 further including means for guiding said latch arm into engagement with said lip.

9. The container of claim 4 wherein said first hinge having one end attached to said sealing cap at a first juncture and another end attached to said tubular member, said second hinge having a first end attached to said locking cap at a second juncture and a second end attached to said tubular member, said hinges being configured such that when said caps are locked together significant movement of said first and second juncture away from the open end of said tubular member is precluded without deformation of said hinges.

10. The container of claim 9 wherein said hinges are attached to said tubular container at locations spaced about 180° from one another.

11. A sealing device comprising:

a first member having an opening;

a fluid impervious second member having a portion sized to fit in said opening and a section that engages said first member adjacent said opening when said portion is positioned in said opening, said portion being formed with a depression extending into said first member when said portion is positioned in said opening;

a third member having a portion that engages said second member when said second member portion is positioned in said opening, and said third member is positioned on said second member, said third member portion comprising a protrusion shaped to fit into said depression;

means for retaining said protrusion within said depression against unintentional dislodgement, said retaining means being formed on said third and one of said first and second members;

a first flexible hinge having a first end attached to said first member and a second end attached to said second member, said hinge having a length such that said section of said second member is prevented from separating from said first member when said second member portion is positioned in said opening; and a second flexible hinge having a first end attached to said first member and a second end attached to said third member, said second hinge having a length such that a section of said third member portion is prevented from separating from said second member when said second member portion is positioned in said opening and said third member is positioned on said second member.

12. The sealing device of claim 11 wherein said retaining means comprises a projection on said second member and a tab on said third member.

13. The sealing device of claim 11 wherein said retaining means comprises a latch on said third member and a lip on said first member.

14. The sealing device of claim 13 wherein said latch extends through said opening and cooperates with said lip when said retaining means is positioned for retaining said second and third members together.

15. A sealable container comprising:

a tubular member having an open end;

a sealing cap including a portion configured to occlude the open end of said tubular member when said sealing cap is positioned over said open end;

a locking cap;

means for releasably locking said sealing and locking caps together when said caps are positioned over said open end;

means for preventing said caps from significantly moving in a direction away from the open end of said tubular member when said caps are positioned over said open end and locked together, said preventing means comprising first and second hinges, said first hinge having one end attached to said sealing cap at a first juncture and another end attached to said tubular member, said second hinge having a first end attached to said locking cap at a second juncture and a second end attached to said tubular member, said hinges being configured such that when said caps are locked together significant movement of said first and second juncture away from the open end of said tubular member is precluded without deformation of said hinges, said sealing and locking caps each including a generally planar flange, said flanges engaging one another when said caps are locked together, said second hinge having a pair of pivot points that are spaced apart from one another a distance substantially equal to the thickness of said sealing cap flange.

* * * * *